US011643931B2

(12) United States Patent
Pellerin

(10) Patent No.: US 11,643,931 B2
(45) Date of Patent: May 9, 2023

(54) BALANCING RING ANTI-ROTATION SPACER

(71) Applicant: PRATT & WHITNEY CANADA CORP., Longueuil (CA)

(72) Inventor: Hugues Pellerin, Montreal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/114,620

(22) Filed: Dec. 8, 2020

(65) Prior Publication Data

US 2022/0178259 A1 Jun. 9, 2022

(51) Int. Cl.
*F01D 5/02* (2006.01)

(52) U.S. Cl.
CPC ..... *F01D 5/027* (2013.01); *F05D 2230/644* (2013.01); *F05D 2260/15* (2013.01)

(58) Field of Classification Search
CPC ..... F01D 5/027; F01D 25/04; F05D 2260/15; F05D 2230/60; F05D 2260/96; G01M 1/30; G01M 1/36; G01M 1/125; B23P 19/107; B23P 19/10; F16F 15/32; F16F 15/322; F16F 15/34; F04D 29/662
USPC ..... 416/144, 145
See application file for complete search history.

(56) References Cited

U.S. PATENT DOCUMENTS

| | | | | |
|---|---|---|---|---|
| 3,964,242 | A | 6/1976 | Bearn, Jr. et al. | |
| 4,294,135 | A * | 10/1981 | Tameo | F16F 15/32 74/571.1 |
| 7,912,587 | B2 | 3/2011 | Walters et al. | |
| 8,122,785 | B2 | 2/2012 | Czerniak et al. | |
| 8,631,578 | B2 | 1/2014 | Glasspoole et al. | |
| 10,383,438 | B2 | 8/2019 | Duval et al. | |
| 10,570,741 | B2 | 2/2020 | Stone et al. | |
| 2002/0134191 | A1* | 9/2002 | Czerniak | F16F 15/34 416/145 |
| 2006/0083619 | A1 | 4/2006 | Roever et al. | |
| 2014/0079537 | A1* | 3/2014 | Arnold | F16F 15/34 415/177 |
| 2014/0250680 | A1* | 9/2014 | Menheere | H02K 7/1823 29/596 |
| 2016/0237824 | A1* | 8/2016 | Himes | F04D 29/644 |

(Continued)

FOREIGN PATENT DOCUMENTS

| | | | |
|---|---|---|---|
| DE | 19920699 | A1 | 12/2000 |
| DE | 102011102315 | A1 | 11/2012 |
| FR | 3087481 | A1 | 4/2020 |

OTHER PUBLICATIONS

European Searhc report issued in counterpart application No. 21213181.7 dated May 27, 2022.

*Primary Examiner* — Eldon T Brockman
*Assistant Examiner* — Maxime M Adjagbe
(74) *Attorney, Agent, or Firm* — Norton Rose Fulbright Canada LLP.

(57) ABSTRACT

A rotating assembly for a gas turbine engine has a balancing ring mounted to a first rotating component having a rotating unbalance about an axis of rotation. The ring is clocked at a circumferential position about the axis to counteract the rotating unbalance. A spacer is axially abutted against the first rotating component to set an axial position of the first rotating component relative to a second rotating component. The balancing ring is locked against rotation relative to the first rotating component in its circumferential position by the dual use spacer.

16 Claims, 8 Drawing Sheets

(56) References Cited

U.S. PATENT DOCUMENTS

2016/0237825 A1* 8/2016 Himes ..... F01D 5/027
2019/0301295 A1* 10/2019 Hernandez ..... F01D 11/008

* cited by examiner

BALANCING RING ANTI-ROTATION SPACER

TECHNICAL FIELD

The application relates generally to rotating structures and, more particularly, to a balancing ring mounting arrangement.

BACKGROUND OF THE ART

Turbo machinery rotating structures are balanced to minimize residual vibration and resulting stresses. A known balancing technique is to add counterweights at predetermined locations to generate an opposite unbalance cancelling the rotating structure initial unbalance. Other techniques include rotation of balancing rings on the rotating structure to cancel the rotating structure initial unbalance. One of the challenges in using such balancing rings is to lock their orientation to secure the unbalance correction once the rings have been properly circumferentially oriented on the rotating structure.

Improvements are, thus, desirable.

SUMMARY

In one aspect, at least one balancing ring is mounted to a rotating component of a rotary stack and is locked against rotation in a desired circumferential position relative to the rotating component by a spacer used to adjust an axial distance between the rotating component and another component of the rotary stack.

In another aspect, the dual use spacer has anti-rotation features for mating engagement with corresponding anti-rotation features on the balancing ring.

In a further aspect, there is provided a spacer which combines two functions into a single component: 1) providing axial adjustment between two components of a rotating assembly and 2) providing a circumferential locking action for balancing rings used to balance a component of a rotating assembly of a gas turbine engine.

In one aspect, the spacer and the at least one balancing ring have a circumferential interface with cooperating anti-rotation male/female portions.

In a further aspect, there is provided a rotating assembly for a gas turbine engine, comprising: a first rotating component mounted for rotation about an axis; at least one balancing ring mounted to the first rotating component and clocked at a circumferential position about the axis to counteract a rotating unbalance of the first rotating component; and a spacer axially abutted against the first rotating component to set an axial position of the first rotating component relative to a second rotating component of the rotating assembly, the spacer locking the at least one balancing ring against rotation relative to the first rotating component.

In a further aspect, there is provided a rotating assembly of a gas turbine engine, comprising: a first rotating component mounted to a shaft for rotation therewith about an axis; at least one circlip mounted to the first rotating component, the at least one circlip having a center of mass offset from the axis, the at least one circlip being adjustably rotatable relative to the first component about the axis to a circumferential position in which the at least one circlip counters a rotating unbalance of the first rotating component; and a spacer axially clamped between the first rotating component and a second rotating component of the rotating assembly, the spacer having scallops circumferentially spaced apart along a circumferential surface thereof around the axis, the scallops engageable with lugs projecting from the at least one circlip for locking the at least one circlip against rotation relative to the first component.

In a still further aspect, there is provided a method of balancing a first rotating component of a stack of rotating components of a gas turbine engine, the first rotating component mounted for rotation about an axis of rotation, the method comprising: mounting at least one circlip in a corresponding seat on the first rotating component, the at least one circlip having a center of mass offset from the axis of rotation; adjusting an angular orientation of the at least one circlip relative to the first rotating component, including rotating the at least one circlip about the axis of rotation to a circumferential position in which the at least one circlip counters a rotating unbalance of the first rotating component; and locking the at least one circlip against rotation relative to the first rotating component using a spacer axially clamped between the first rotating component and a second rotating component of the stack of rotating component.

DESCRIPTION OF THE DRAWINGS

Reference is now made to the accompanying figures in which.

DETAILED DESCRIPTION

Figure 1:
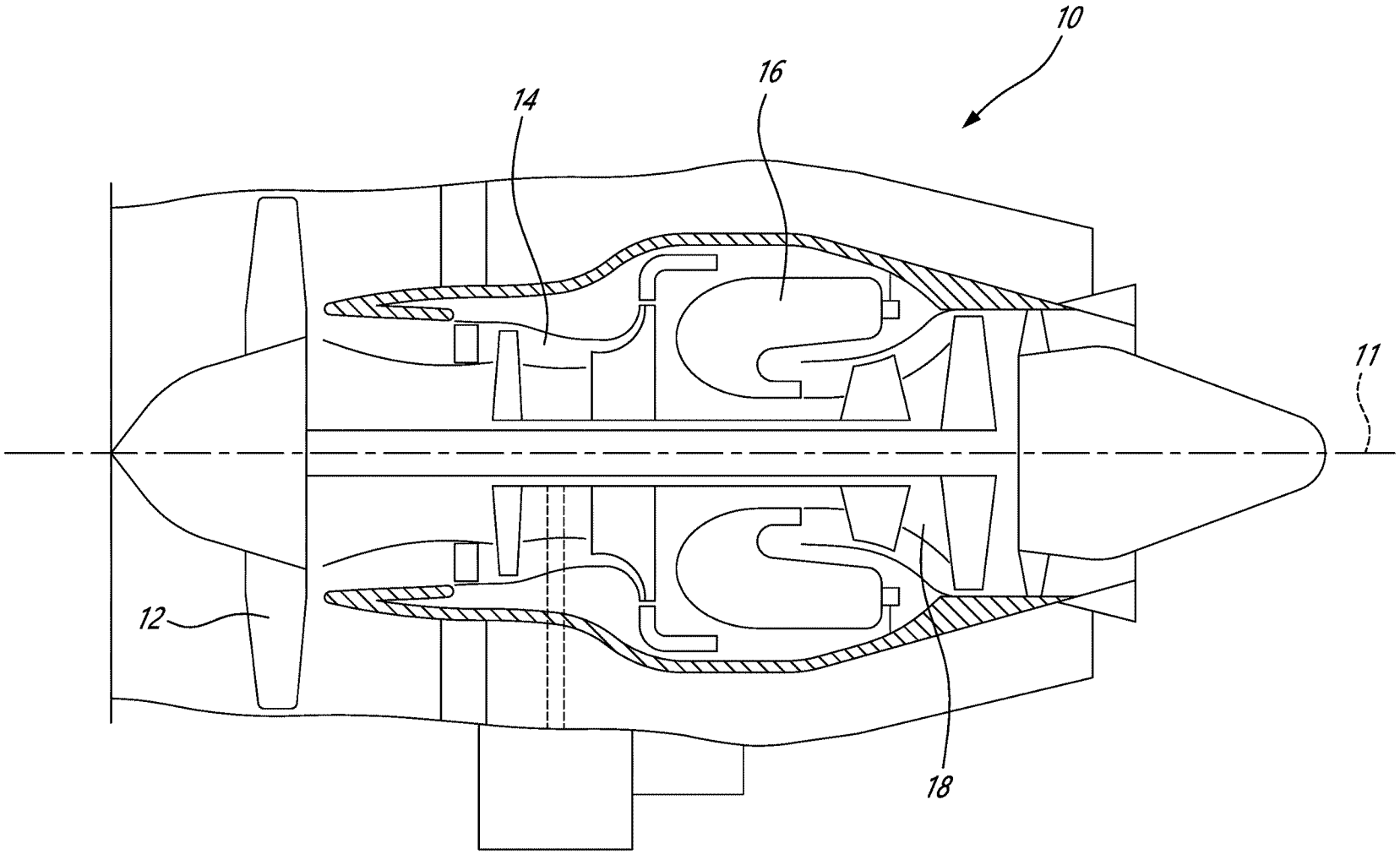
FIG. 1 is a schematic cross-section of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

The exemplified engine 10 is a multi-spool engine including multiple rotating assemblies (e.g. a high pressure spool and a low pressure spool) mounted for rotation about an axis 11 (e.g. the engine centerline). Each rotating assembly may comprise a stack of rotating components axially clamped together on a shaft. For instance, each stack may comprise one or more compressor rotors, one or more turbine rotors, front and rear seal runners, one or more bearings, one or more oil scoops, and one or more spacers secured together on a shaft for rotation therewith. According to another example, the rotating assembly may consist of a transmission shaft with its associated gears and spacers. For instance, a rotating assembly could include a gear mounted to a transmission shaft with a spacer on the shaft to adjust a position of the gear relative to its pinion. The above examples of rotating assemblies are not intended to constitute an exhaustive list of all rotating assemblies found in gas turbine engines.

The term "spacer" is herein intended to generally refer to a purposely designed part introduced in a rotary stack to adjust the distance between two rotating components taking account of the stacked parts actual axial length. For example, in a turbo machine, spacers may be used to adjust the axial distance between the compressor and the turbine with respect to the stators to maximize engine performance. As mentioned above, spacers can also be used to adjust the position of a gear in relation to its pinion. Optimal spacer length is computed by measuring relevant dimensions in the rotary stack. The optimal computed spacer length is used to either grind an oversized part or is used to select a specific spacer length among pre-cut parts.

Figure 2:
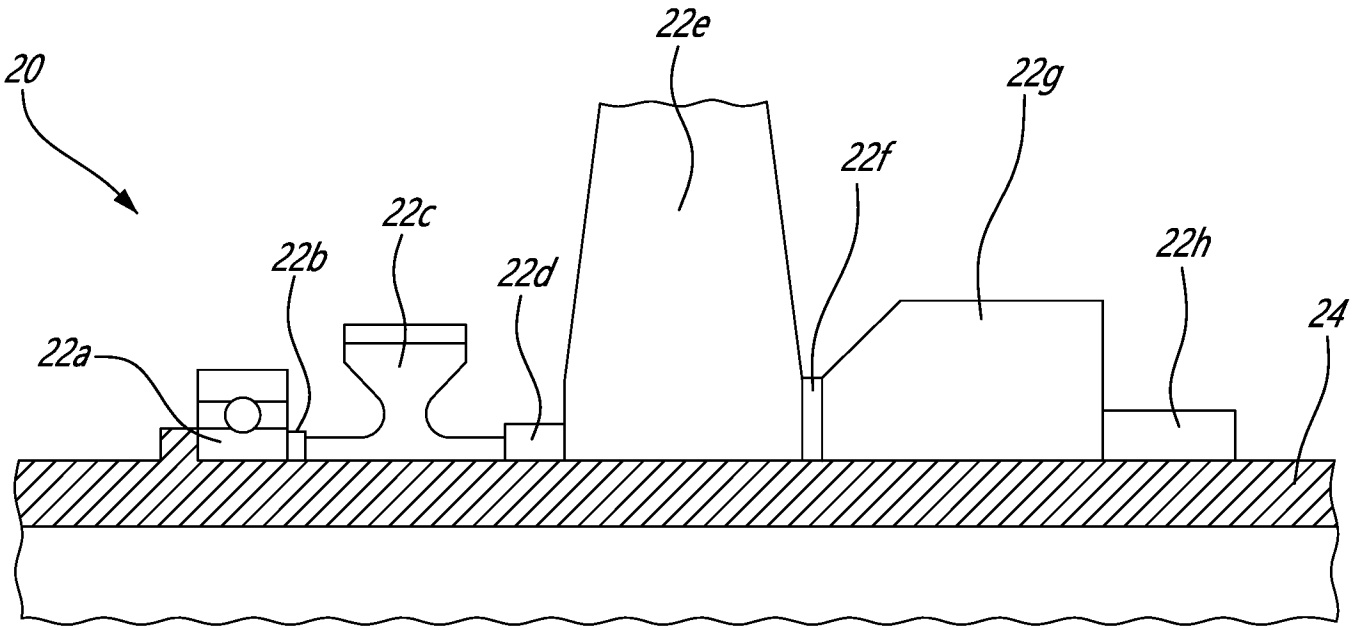
FIG. 2 is a schematic cross-section of a rotating assembly of the gas turbine engine.

FIG. 2 is a simplified schematic view of an exemplary rotating assembly 20 comprising a number of rotating components 22*a*-22*h* axially clamped together on a rotating shaft 24 for rotation about axis 11 of the gas turbine engine 10. The rotating assembly 20 needs to be balanced. A rotating unbalance is known as an uneven distribution of mass around an axis of rotation. A rotating component is said to be out of balance when its center of mass (inertia axis) is out of alignment with the center of rotation (geometric axis). Unbalance may cause a moment which gives the rotating component a wobbling movement characteristic of vibration of rotating structures.

As will be seen hereinafter, such a rotating unbalance may be corrected through the addition of dedicated balancing rings to an unbalance rotating component of a rotating assembly and by adjusting the relative angle between the balancing rings depending on the unbalance to be corrected. Once properly "clocked" (i.e. angularly oriented in the circumferential direction), the balancing rings are locked against rotation in their unbalance correction positions by a dual use spacer as exemplified in FIGS. 3-9.

Figures 3A, 3B, 3C:
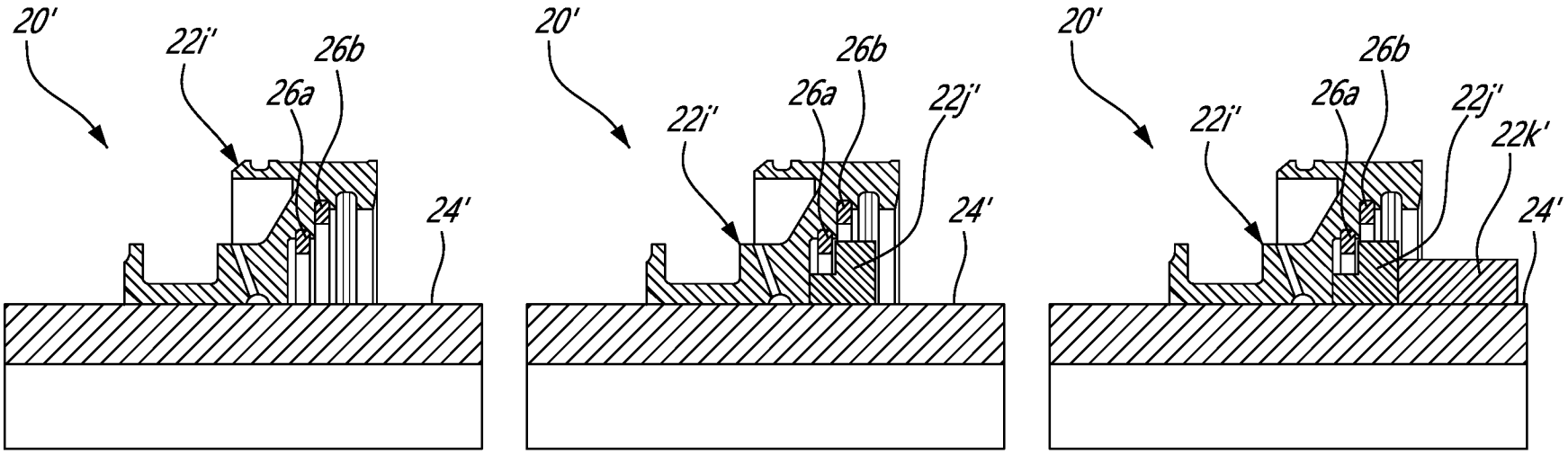
FIGS. 3*a*-3*c* are cross-section views illustrating an assembly sequence of a pair of balancing rings on a rotating component having an initial unbalance that needs to be corrected, the balancing rings locked against rotation relative to the rotating component by a dual use spacer having an anti-rotation interface with the rings.

FIGS. 3*a*-3*c* illustrate an assembly sequence for correcting a rotating unbalance in a component of a given rotating assembly. More particularly, FIGS. 3*a*-3*c* illustrates a rotating assembly 20' comprising a seal runner 22*i'* press fit to a shaft 24', a spacer 22*j'* mounted with a loose fit on the shaft 24' and axially abutted against the seal runner 22*i'* to allow for the adjustment of an axial position of the seal runner 22*i'* relative to another rotating component 22*k'*, which is, in turn, press fit to the shaft 24' axially against the spacer 22*j'*, thereby axially clamping the spacer 22*j'* in a secured position. The seal runner 22*i'*, the spacer 22*j'* and rotating component 22*k'* may correspond to some of the rotating components 22*a*-22*h* of the stack of rotating components shown in FIG. 2 or they could be part of another rotating assembly of the gas turbine engine 10.

As exemplified in FIG. 3*a*, one or more balancing rings 26*a*, 26*b* may be detachably mounted to the seal runner 22*i'* to correct its initial rotating unbalance. According to the illustrated embodiment, the balancing rings comprise a pair of balancing rings 26*a*, 26*b*. However, it is understood that a different number of balancing rings could be used. As shown in FIG. 3*a*, the balancing rings 26*a*, 26*b* can have different diameters. However, it is understood that balancing rings 26*a*, 26*b* could have the same size.

Figure 6:
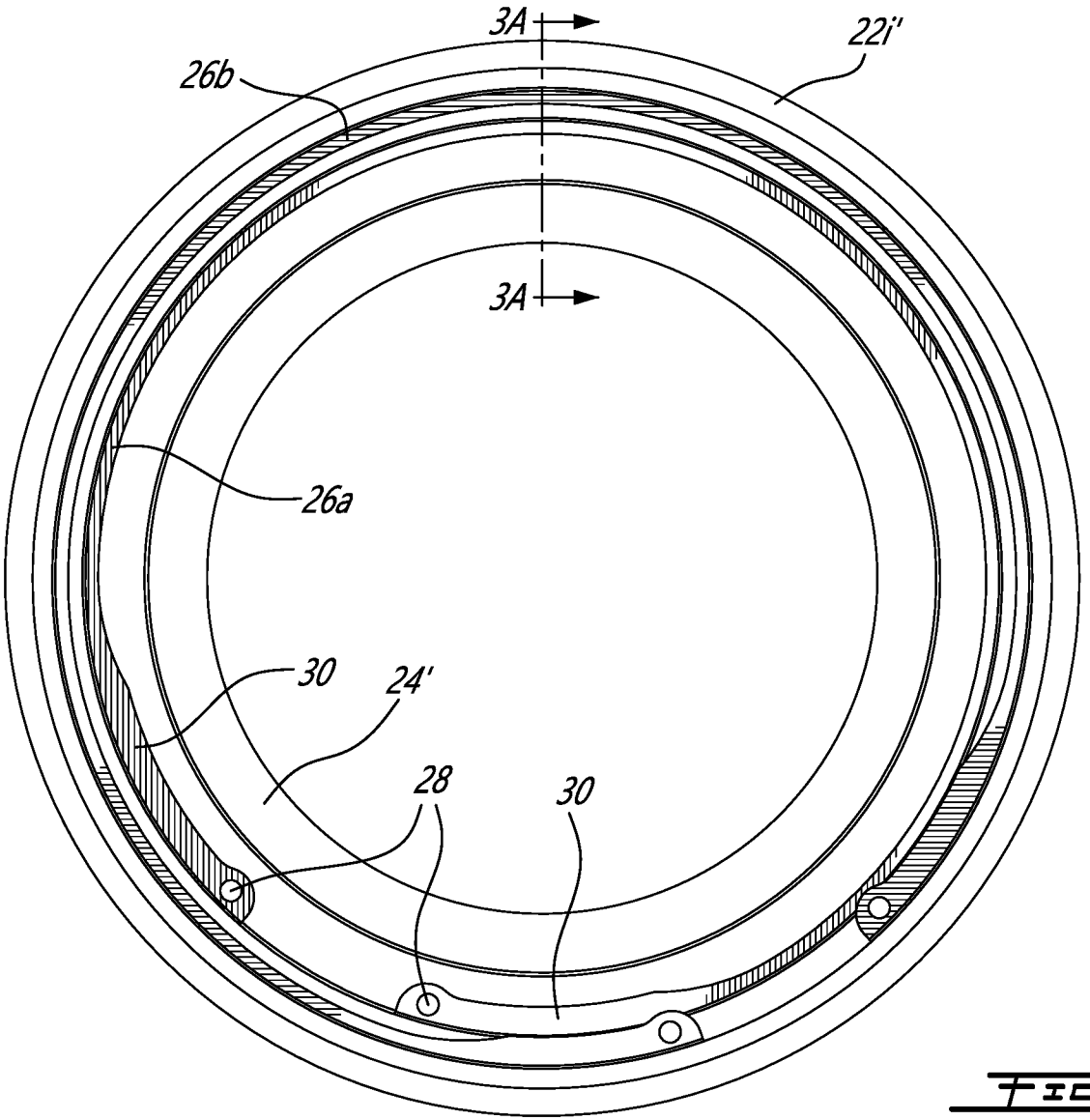
FIG. 6 is an end view of a pair of balancing rings installed on the rotating component to be balanced and showing the rings clocked for a given unbalance correction.

The balancing rings 26*a*, 26*b* have an uneven distribution of mass around their circumference so that the center of mass of each ring is offset from its geometrical center, which corresponds to the rotating axis 11 of the shaft 24' once the rings 26*a*, 26*b* are mounted to the seal runner 22*i'*. By adjusting the relative angular position of the rings 26*a*, 26*b* on the seal runner 22*i'* about the axis of shaft 24', a balancing force can be generated, the intensity of the balancing force being determined by the relative angular position between the two counterbalance rings 26*a*, 26*b*. The balancing force generated varies from zero (when the two rings 26*a*, 26*b* are diametrically opposed for counterbalance weights of similar mass), to the sum of the counterbalance weights when the two counterbalance mass eccentricities of the rings 26*a*, 26*b* are angularly aligned about a circumference of the seal runner 22*i'*. FIG. 6 illustrates a relative angular orientation of the balancing rings 26*a*, 26*b* for correcting a given rotating unbalance of the seal runner 22*i'*.

Figure 4:
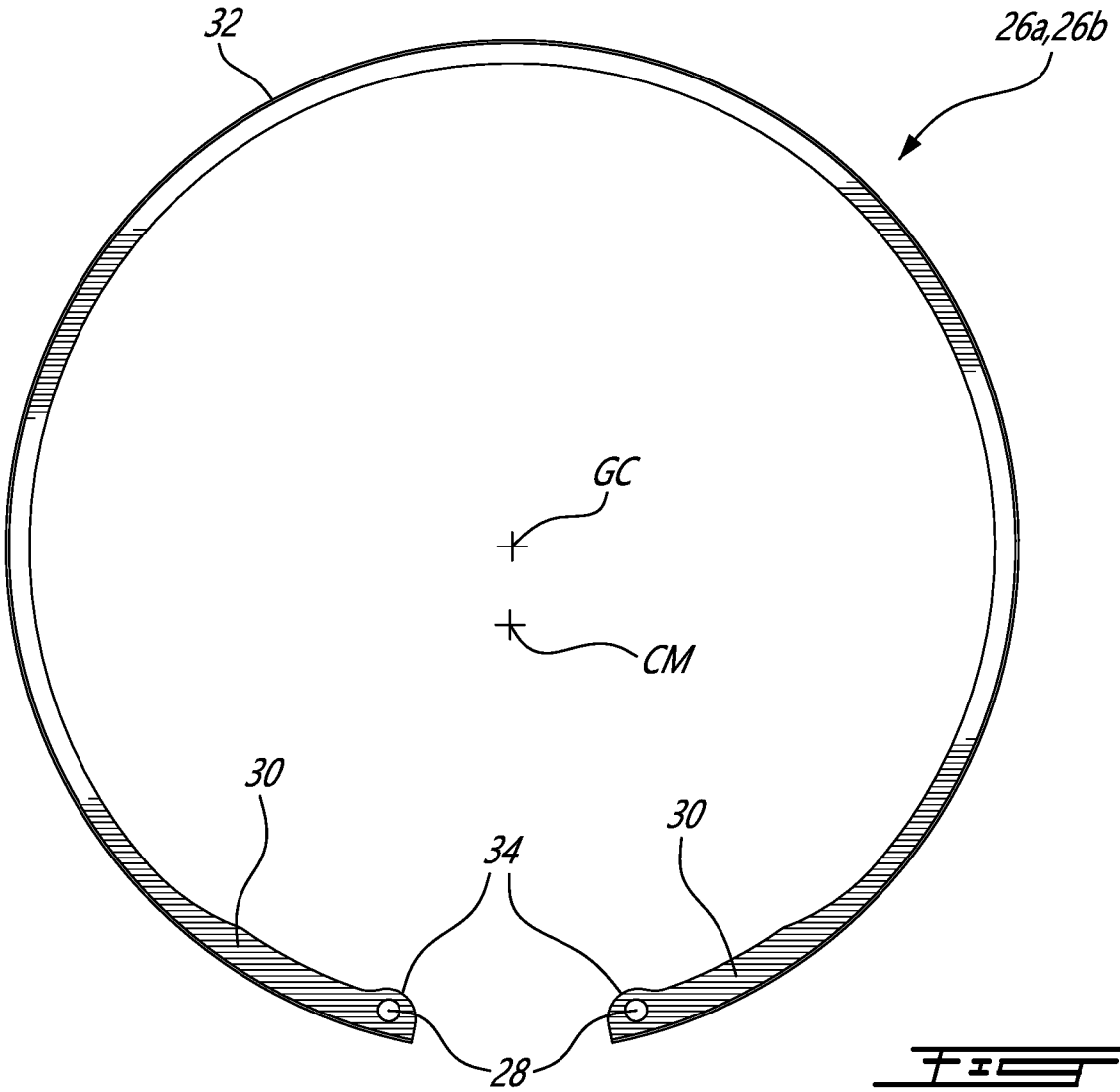
FIG. 4 is a front view of a balancing ring exemplified in the form of an internal circlip provided with anti-rotation lugs on its inner diameter surface for mating engagement with corresponding scallops provided on an outer diameter surface of the spacer.

As shown in FIG. 4, each balancing ring 26*a*, 26*b* can be provided in the form of a circlip or snap ring having a semi-flexible ring body with open ends which can be snapped into an annular retaining groove or other suitable seat defined in the rotating component to be balanced. The circlip can be internal (FIGS. 3*a*-3*c*, 4, 6 and 7) or external (FIGS. 8-9), referring to whether it is fitted into the rotating component or thereover. The exemplary circlip 26*a*, 26*b* shown in FIG. 4 is designed to be installed and removed with special pliers (not shown). Holes 28 can be defined in the end portions 30 of the circlip for engagement with the pliers.

As can be appreciated from FIG. 4, extra material can be provided at desired locations around the circumference of the circlip to offset the center of mass CM of the circlip 26*a*, 26*b* from its installed center of rotation GC. According to the illustrated embodiment, the extra material is provided at the end portions 30 of the circlip. However, it is understood that it could be provided at other circumferential locations. The circlip illustrated in FIG. 4 has a smooth outer diameter surface 32 for engagement with a corresponding smooth diameter surface of the associated retaining groove in the seal runner 22*i'*. The smooth circumferential interface between the circlip 26*a*, 26*b* and the seal runner 22*i'* allows to adjustably rotate the circlip relative to the seal runner 22*i'* about the axis of shaft 24' between an infinite number of angular positions (in contrast to a mounting arrangement offering discrete mounting positions in the circumferential direction) for correcting the rotating unbalance. That is the circlip shown in FIG. 4 can be installed at virtually any angular positions in the circumferential direction on the runner 22*i'*. The term "smooth" interface is used herein in opposition to mating surfaces having discrete positioning features for providing for incremental adjustment of the relative position of the two mating components between discrete positions.

Figure 7:
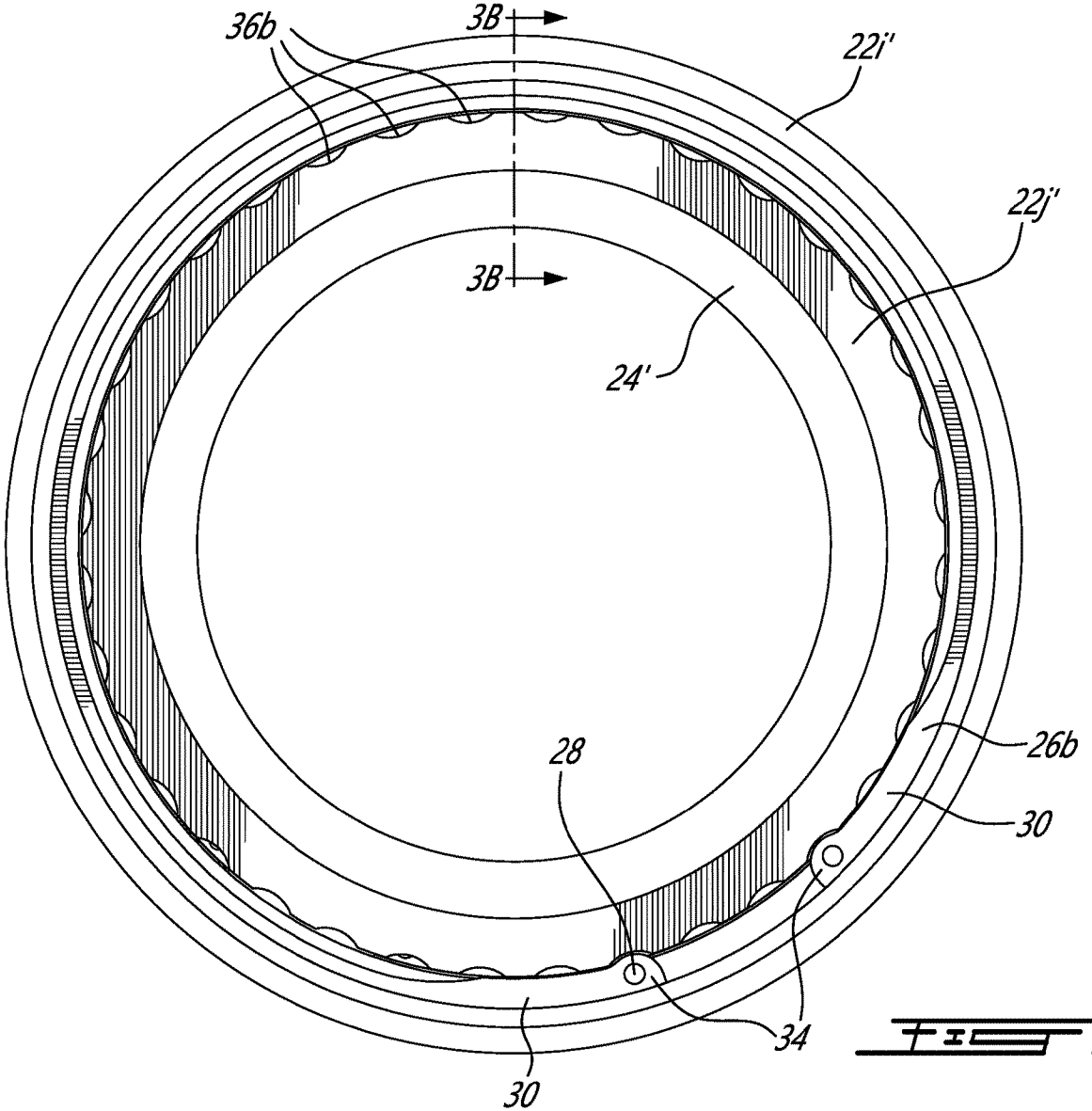
FIG. 7 is an end view of the assembled dual use spacer, the anti-rotation rings and the rotating component showing the anti-rotation capabilities of the spacer.

One of the challenges in using balancing rings, such as circlips, is to lock their angular orientation to secure the unbalance correction once they have been assembled with the desired correction orientation on the rotating component to be balanced (as for instance shown in FIG. 6). As shown in FIGS. 3*b* and 7, it is herein proposed to use the spacer 22*j*' to secure the angular position of the circlips 26*a*, 26*b* relative to the seal runner 22*i*'. The integration of the anti-rotation function to an existing component (i.e. the spacer 22*j*') of the rotating assembly 20' eliminates the need for an additional anti-rotation component. Integrating this function to the spacer 22*j*' as opposed to the seal runner 22*i*' also allows for the above described smooth interface between the seal runner 22*i*' and the circlips 26*a*, 26*b*, thereby contributing to facilitate the manipulation and positioning of the circlips 26*a*, 26*b* on the seal runner 22*i*' during the balancing correction of a rotating unbalance.

As shown in FIG. 7, the spacer 22*j*' and the circlips 26*a*, 26*b* have a circumferential interface with cooperating anti-rotation male/female portions. According to the embodiment illustrated in FIGS. 3-7, the anti-rotation interface comprises male portions, which can, for instance, take the form of built-in ears or lugs 34 (FIGS. 4 and 7) projecting from an inner diameter surface of the circlips 26*a*, 26*b*, for mating engagement with corresponding female portions, such as axially adjacent arrays of circumferentially spaced-apart scallops 36*a*, 36*b* (FIGS. 5 and 7) provided on an outer diameter surface of the spacer 22*j*'. It is understood that the female portions could be provided on the inner diameter surface of the circlips 26*a*, 26*b* and that the male portions could be provided on the outer diameter surface of the spacer 22*j*'. In the embodiment of the circlip illustrated in FIG. 4, the lugs 34 are provided at the end portions 30 of the circlip 26*a*, 26*b*. However, it is understood that the lugs 34 could be provided at other locations around the inner diameter surface of the circlip 26*a*, 26*b*. Furthermore, while the illustrated embodiment comprises two lugs 34, it is understood that a different number of lugs 34 could be provided for engagement with corresponding scallops of the arrays of scallops 36*a*, 36*b* on the spacer 22*j*'.

Figure 5:
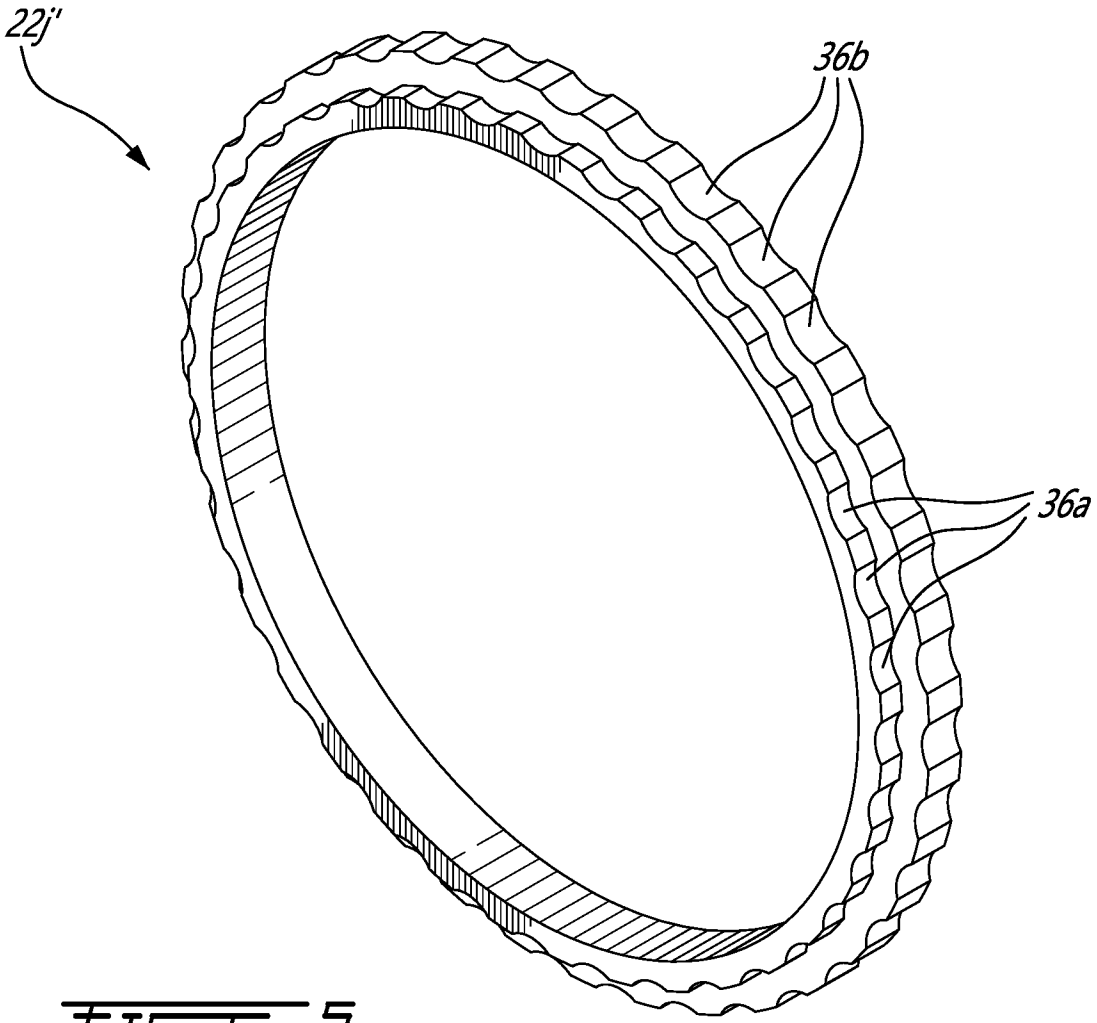
FIG. 5 is an isometric view of an exemplary spacer, the illustrated spacer having two arrays of circumferentially spaced-apart scallops on two different outer diameter surfaces for mating engagement with the anti-rotation lugs of two different sizes of balancing rings, the scallops and the lugs cooperating to provide an anti-rotation feature.

Now referring more particularly to FIG. 5, it can be seen that the two arrays of circumferentially spaced-apart scallops 36*a*, 36*b* can be provided on two different diameters. Indeed, according to the illustrated embodiment, the spacer 22*j*' has a hollow cylinder body with two different outer diameter surfaces, each outer diameter surface having an array of circumferentially spaced-apart scallops 36*a*, 36*b* for mating engagement with the two different sizes of circlips 26*a*, 26*b* as shown in FIGS. 3*a*-3*c*. Referring to FIG. 3*b*, it can be seen that the smaller outer diameter portion of the spacer 22*j*' is abutted axially against an inner abutting surface of the seal runner 22*i*' to axially align the first array of scallops 36*a* on the smaller outer diameter of the spacer 22*j*' with the smaller diameter circlip 26*a*. The second arrays of scallops 36*b* on the larger outer diameter of the spacer 22*j*' is axially aligned with the larger diameter circlip 26*b*. The use of two different sizes of circlips 26*a*, 26*b* allows to re-adjust the position of the first circlip 26*a* without having to first remove the second circlip 26*b* once both circlips 26*a*, 26*b* have been installed on the runner 22*i*'. However, it is understood that only one size of circlips could be used. In this case, both arrays of circumferentially spaced-apart scallops 36*a*, 36*b* would be provided on a same outer diameter surface of the spacer 22*j*'.

It can be appreciated that the spacer function of the spacer 22*j*' is provided by the axial length adjustment of the spacer, in the same fashion as a traditional spacer, and the anti-rotation function is provided by the scallops 36*a*, 36*b* on the outer diameter of the body of the spacer 22*j*'. There is no need to have a tight fit on the spacer/circlip interface since the engagement of the lugs 34 in the scallops 36*a*, 36*b* do not allow the circlips 26*a*, 26*b* to rotate. As the scallops 36*a*, 36*b* mate with the circlip inner lugs 34; the circlips 26*a*, 26*b* are locked against rotation provided that sufficient friction load holds the spacer 22*j*'. Even though the spacer 22*j*' is designed to have a gap on its inner diameter and outer diameter, the spacer 22*j*' is clamped by the rotor stack compression preload via component 22*k*', as shown in FIG. 3*c*. Therefore, the friction load does not allow the spacer 22*j*' to move in any operating condition.

By using the spacer 22*j*' to lock the circlips 26*a*, 26*b* in rotation relative to the seal runner 22*i*', the circlips can be positioned at any desired orientation during the balancing operation. In the case where only one circlip is used, it can be locked at any orientation. Where two circlips are used as described in connection with the illustrated embodiment, the spacer 22*j*' doubles as a go/no go gauge to assess the allowable position of one circlip in relation with the other one prior to the balancing validation operation.

It is understood that the exemplified circlip 26*a*, 26*b* and spacer 22*j*' respectively shown in FIGS. 4 and 5 could vary in the circlip detail designed as well as scallops count and shape. Notably, the shape of scallops 36*a*, 36*b* could be configured to allow a slight movement of the lugs 34 within the scallops 36*a*, 36*b* to provide additional positioning freedom to correct a rotating unbalance. For instance, the scallops 36*a*, 36*b* could have a slightly greater radius of curvature than that of the lugs 34. It is understood that the profile of the scallops and mating lugs does not need to be circular. For instance, the lug/scallop could be designed in the same manner as a dovetail fitting.

The seal runner 22*i*' of the rotating assembly 20' can be balanced in the following manner. Before an installation of the circlips 26*a*, 26*b* and the dual function spacer 22*j*', an initial rotating unbalance of the runner 22*i*' is determined in a manner already known in the art. A point of maximum unbalance on the runner 22*i*' is determined and a required balancing correction is computed. Using a simple computer program, chart or formula, a relative angular position required between the balancing rings 26*a*, 26*b* to generate the required balancing correction is computed. The circlips 26*a* and 26*b* are then installed on the runner 22*i*' and the position thereof in the circumferential direction is adjusted to counteract the rotating unbalance of the seal runner 22*i*'. Then, the spacer 22*j*' is axially engaged with a loose fit on the shaft 24' and angularly positioned in the circumferential direction so as to align some of the scallops 36*a*, 36*b* with the lugs 34 on the circlips 26*a*, 26*b* (FIG. 7). Then, the spacer 22*j*' is axially abutted against the runner 22*i*' as shown in FIG. 3*b*. In this position, the lugs 34 of the circlips 26*a*, 26*b* are engaged with corresponding scallops 36*a*, 36*b* on the outer diameter of the spacer 22*j*'. Thereafter, component 22*k*' is press fit on the shaft 24' in clamping engagement with the spacer 22*j*', thereby axially and circumferentially securing the rotating assembly 20'.

Figure 9:
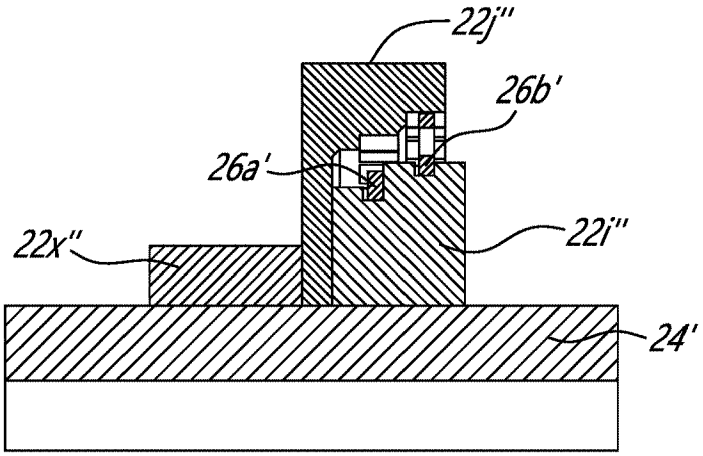
FIG. 9 is a cross-section view taken along line 9-9 in FIG. 8.
Figure 8:
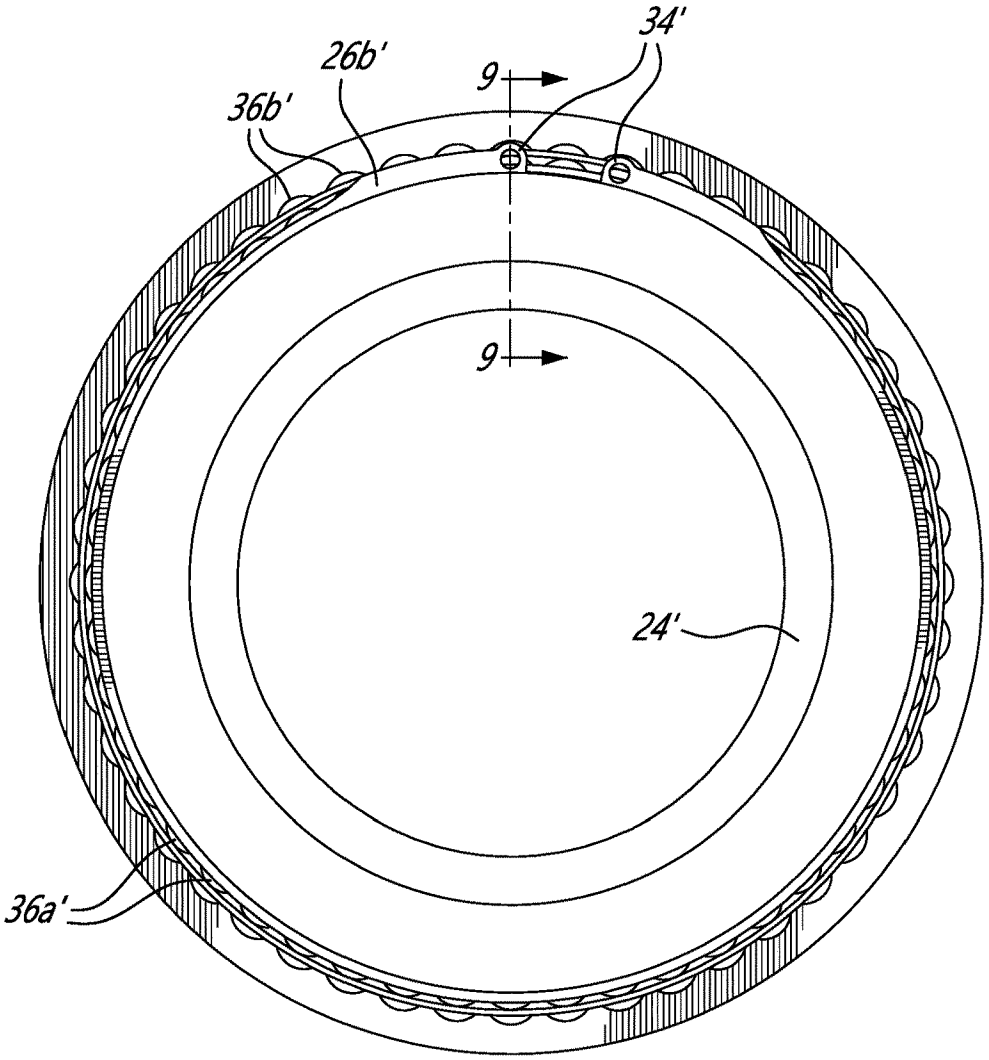
FIG. 8 is an end view similar to FIG. 7 but illustrating an embodiment in which external circlips are mounted to an outer diameter surface of a rotating component, the circlips having external lugs for anti-rotation engagement with mating scallops provided on an inner diameter surface of a dual use spacer.

FIGS. 8 and 9 illustrate another embodiment using the same parts, i.e. a rotating component 22*i*" to be balanced, two different sizes of circlips 26*a*', 26*b*' mounted to the rotating component 22*i*" for correcting the rotating unbalance, a dual use spacer 22*j*" and a clamping component 22*k*", but with externally mounted circlips instead of internal ones. More particularly, the variant illustrated in FIGS. 8 and 9 mainly differs from the embodiment shown in FIGS. 3 to 7 in that external circlips 26*a*', 26*b*' are mounted in respective grooves defined in an outer diameter surface of the rotating component 22*i*" to be balanced. According to this variant, the lugs 34' project from the outer diameter of the circlips 26*a*', 26*b*' for mating engagement with scallops of two corresponding arrays of scallops 36*a*', 36*b*' defined in two different inner diameter surfaces of the spacer 22*j*". According to this variant, the circlips 26*a*', 26*b*' may be snug into the scalloped inner diameter of the spacer 22*j*". In this configuration, the circlip positions are first adjusted outside of the rotating component 22*i*". Then, the spacer 22*j*", to which the circlips 26*a*' 26*b*' are clamped, is positioned in the rotor assembly and axially clamped with component 22*k*" on shaft 24'.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, it is understood that the various described balancing arrangements can be applied to a wide variety of rotating assemblies and rotating components. Also, while the balancing rings have been described as circlips it is understood that other suitable forms of balancing rings could be used. Yet further modifications could be implemented by a person of ordinary skill in the art in view of the present disclosure, which modifications would be within the scope of the present technology.

The invention claimed is:

1. A rotating assembly for a gas turbine engine, comprising:

a first rotating component mounted for rotation about an axis;

at least one balancing ring mounted to the first rotating component and clocked at a circumferential position about the axis to counteract a rotating unbalance of the first rotating component, the at least one balancing ring including a first and a second circlip; and a spacer axially abutted against the first rotating component to set an axial position of the first rotating component relative to a second rotating component of the rotating assembly, the spacer locking the first and second circlips against rotation relative to the first rotating component, the spacer having a first and a second circumferential array of scallops on two different diameters, the first and second circlips having different diameters for locking engagement with the first and second circumferential arrays of scallops, respectively.

2. The rotating assembly as defined in claim 1, wherein the first and second circlips each include at least one lug engageable with a selected one of the scallops of the first and second circumferential array of scallops.

3. The rotating assembly defined in claim 2, wherein the first and second circumferential array of scallops are provided on an inner or an outer diameter of the spacer.

4. The rotating assembly as defined in claim 1, wherein the at least one balancing ring is adjustably rotatable in a circumferential direction relative to the first rotating component between an infinite number of circumferential positions.

5. The rotating assembly as defined in claim 4, wherein the at least one balancing ring has a smooth circumferential surface engaged with a corresponding smooth circumferential seating surface on the first rotating component.

6. The rotating assembly as defined in claim 1, wherein the first rotating component is press fit to a shaft, the spacer is mounted to the shaft with a loose fit, wherein the spacer is axially clamped between the first rotating component and the second rotating component, and wherein the second rotating component is press fit to the shaft.

7. The rotating assembly as defined in claim 1, wherein the first and second circlips have built-in lugs, wherein the spacer is axially clamped in sandwich between the first and second rotating components, the first and second circumferential arrays of scallops in circumferential locking engagement with the built-in lugs, thereby locking the first and second circlips against rotation relative to the first rotating component.

8. A rotating assembly of a gas turbine engine, comprising:

a first rotating component mounted to a shaft for rotation therewith about an axis;

at least one circlip mounted to the first rotating component, the at least one circlip having a center of mass offset from the axis, the at least one circlip being adjustably rotatable relative to the first component about the axis to a circumferential position in which the at least one circlip counters a rotating unbalance of the first rotating component; and a spacer axially clamped between the first rotating component and a second rotating component of the rotating assembly, the spacer having scallops circumferentially spaced apart along a circumferential surface thereof around the axis, the scallops engageable with lugs projecting from the at least one circlip for locking the at least one circlip against rotation relative to the first component;

wherein the at least one circlip comprises first and second circlips, the first circlip having a smaller diameter than the second circlip, and wherein the scallops include first and second arrays of scallops circumferentially distributed on two different diameters of the spacer for engagement with the first and second circlips, respectively.

9. The rotating assembly as defined in claim 8, wherein the at least one circlip has a smooth circumferential interface with the first rotating component to provide for an infinite number of possible angular orientations of the at least one circlip relative to the first rotating component.

10. The rotating assembly as defined in claim 9, wherein the at least one circlip has a smooth outer diameter surface, and wherein the lugs extend from an inner diameter surface of the at least one circlip.

11. The rotating assembly as defined in claim 10, wherein the circumferential surface of the spacer with the scallops is provided on an outer diameter of the spacer.

12. The rotating assembly as defined in claim 8, wherein the first and second rotating components are press fit to the shaft, and wherein the spacer is mounted to the shaft with a loose fit.

13. A method of balancing a first rotating component of a stack of rotating components of a gas turbine engine, the first rotating component mounted for rotation about an axis of rotation, the method comprising:

mounting at least one circlip in a corresponding seat on the first rotating component, the at least one circlip having a center of mass offset from the axis of rotation, wherein mounting the at least one circlip comprises mounting first and second circlips on two different diameters of the first rotating component;

adjusting an angular orientation of the at least one circlip relative to the first rotating component, including rotating the at least one circlip about the axis of rotation to a circumferential position in which the at least one circlip counters a rotating unbalance of the first rotating component; and locking the at least one circlip against rotation relative to the first rotating component using a spacer axially clamped between the first rotating component and a second rotating component of the stack of rotating components.

14. The method as defined in claim 13, comprising angularly aligning scallops distributed on a circumferential surface of the spacer with corresponding lugs projecting from the at least one circlip and axially sliding the spacer along a shaft in abutment against the first rotating component so as to engage the lugs into the scallops aligned therewith.

15. The method as defined in claim 14, comprising mounting the second rotating component with a press fit to the shaft and in axial abutment with the spacer.

16. The method as defined in claim 13, comprising engaging the first and second circlips in locking engagement with first and second scalloped surfaces, respectively, the first and second scalloped surfaces being provided on two different diameters of the spacer.

* * * * *